US008826573B1

(12) United States Patent
Morera

(10) Patent No.: US 8,826,573 B1
(45) Date of Patent: Sep. 9, 2014

(54) LOOSE LEAF CARD HOLDER

(71) Applicant: Lawrence Morera, Beverley Hills, CA (US)

(72) Inventor: Lawrence Morera, Beverley Hills, CA (US)

( * ) Notice: Subject to any disclaimer, the term of this patent is extended or adjusted under 35 U.S.C. 154(b) by 0 days.

(21) Appl. No.: 14/058,288

(22) Filed: Oct. 21, 2013

Related U.S. Application Data

(63) Continuation-in-part of application No. 13/286,506, filed on Nov. 1, 2011, now abandoned.

(51) Int. Cl.
*G09F 3/18* (2006.01)
*G09F 1/10* (2006.01)
*G09F 3/20* (2006.01)

(52) U.S. Cl.
CPC ... *G09F 1/10* (2013.01); *G09F 3/20* (2013.01)
USPC ..... 40/735; 40/654.01

(58) Field of Classification Search
USPC ..... 40/654.01, 775, 735, 376, 389, 390, 40/400, 402, 405, 606.15, 732, 733, 779; 206/455, 308.1; 402/79; 211/40, 41.12, 211/50, 55, 56, 58, 47, 48
See application file for complete search history.

(56) References Cited

U.S. PATENT DOCUMENTS

| | | | | |
|---|---|---|---|---|
| 132,314 | A * | 10/1872 | Moulton | 40/732 |
| 6,112,445 | A * | 9/2000 | Feeney | 40/747 |
| 6,282,826 | B1 * | 9/2001 | Richards | 40/654.01 |
| 6,854,203 | B2 * | 2/2005 | Kern et al. | 40/492 |
| 2006/0151344 | A1 * | 7/2006 | Mundy et al. | 206/308.1 |
| 2008/0035502 | A1 * | 2/2008 | Merzon | 206/308.1 |

* cited by examiner

*Primary Examiner* — Joanne Silbermann
(74) *Attorney, Agent, or Firm* — Deborah Wenocur

(57) ABSTRACT

The present device is a loose-leaf card holder adapted for storing and displaying encapsulated collectible cards. The loose-leaf card holder comprises a frame adapted to mount pockets thereto. In an embodiment, the pockets are mounted rotatably onto the frame so as to be positioned out of the plane of the frame during insertion of a card.

10 Claims, 3 Drawing Sheets

LOOSE LEAF CARD HOLDER

CROSS-REFERENCE TO RELATED APPLICATIONS

This application is a Continuation-in-Part of copending U.S. application Ser. No. 13/286,506, filed Nov. 1, 2011, and claims priority thereto. Application Ser. No. 13/286,506 is hereby incorporated by reference in its entirety.

STATEMENT REGARDING FEDERALLY SPONSORED RESEARCH AND DEVELOPMENT

Not Applicable.

FIELD OF THE INVENTION

This invention relates to loose-leaf card holders, and more particularly to a loose-leaf card holder adapted for storing and displaying professionally graded sports cards.

DISCUSSION OF RELATED ART

Card collectors often store many types of collectible cards, such as: sports cards, magic cards, comic cards, TV show cards, etc., in loose-leaf card holders that are bound together in a card storage book. A conventional card holder is adapted for holding a plurality of cards therein. However, the conventional loose-leaf card holders do not provide an adequate facility for storing and displaying encapsulated cards such as professionally graded sports cards. Professionally graded sports cards are examined by a professional grader for determining its condition. Once the condition has been determined, the card is sonically sealed inside a protective tamper-proof holder with a tagged label for showing its certification number, manufacturer, grade, date, unique barcode and players' name for ensuring the card's protection and authenticity. Other types of encapsulations may be used for collectible cards. For the purposes of this disclosure, a "collectible card" is defined as an encapsulated card sealed, e.g., sonically sealed, inside a protective tamper-proof holder. The encapsulated collectible cards, such as the professionally graded sports cards sealed within the holders, have a substantial weight and thickness, and are therefore not easily displayed in conventional albums designed for photographs and the like. The invention can also be used for cards sealed in a different way, but in a package of similar size and material to the standard way described herein. Several prior arts are known for storing and displaying sports cards. For example, U.S. Pat. No. 5,119,574 to King on Jun. 9, 1992 discloses a collector's album comprising a binder and display pages having at least one pocket for receiving collectible display items. Each display page includes transparent front and back panels with the front panels having pockets defined by recessed base surfaces and peripheral retaining walls. Retaining members are cooperative with the peripheral retaining walls to releasably retain display items and associated transparent display covers within the corresponding pockets. Such a device doesn't possess acid free archival quality for a long term display and protection of collectible cards.

One prior art device, taught in U.S. Pat. No. 5,323,553 to Candido on Jun. 28, 1994 discloses an album sleeve for storing and displaying baseball cards. The sleeve is created from a rectangular blank of transparent plastic film having three transverse fold lines whose parallel positions are such that when the blank is folded on the first line, it then defines a front panel overlying a rear panel. The second fold line defines a broad flap section which is folded over the back of the rear panel to complete the sleeve. The third fold line defines a narrow flap section that is folded down to form an expandable internal pocket. However, the pockets lack strong welds and don't possess adequate strength and space for accommodating encapsulated collectible cards.

U.S. Pat. No. 5,651,202 to Hewitt on Jul. 29, 1997 provides a display system suitable for displaying and protecting card-like objects. The display system includes an expandable display device and a card holder. The expandable display includes a primary backing panel and a frame assembly providing a contiguous border around a periphery of the primary backing panel. The card holder includes a transparent first panel and a transparent second panel that selectively engages the first panel to hold the card-like object. Such a device doesn't facilitate users repeated access to the cards. The panels lack high clarity and may block or distort the appearance of the card.

Another prior art device, taught in U.S. Pat. No. 6,971,520 to Fulda on Dec. 6, 2005 discloses a flexible card holder and display which enables a plurality of cards to be attached, transported, displayed and stored. The card holder comprises a sheet of thin, tear-resistant material into which a plurality of slits have been cut. The slits are arranged to receive portions of the cards on the sheet. In such a device, the cards are loosely held in the slit. When the slit is manipulated as in turning the page, the card may then slip out off the open ends of the sleeve, and may get damaged.

Other potential problems can occur for the currently available card holder designs due to the thickness of the encapsulated collectible cards in their holders. First of all, designs which incorporate slits as openings for inserting the cards risk placing considerable stress on the ends of the slits during insertion or after insertion, thereby risking tears or other damage. Additionally, there may be interference between cards, especially when a card is being inserted into a pocket.

Therefore, there is a need for an improved loose-leaf card holder that would have strong pockets for preventing the card from falling out and allow users for repeatedly accessing their cards. Further, such a loose-leaf card holder would be made from a high clarity material and would possess acid free archival quality for storing and displaying encapsulated collectible cards. Moreover, such a loose-leaf card holder would have adequate pocket size and strength for storing and displaying encapsulated collectible cards. The loose-leaf card holder would provide a way to insert cards into pockets without interfering with adjacent mounted cards or causing stress at the insertion site. The present invention accomplishes these objectives.

SUMMARY OF THE INVENTION

The present device is a loose-leaf card holder adapted for storing and displaying encapsulated collectible cards. The loose-leaf card holder comprises a frame adapted to mount pockets thereto. In an embodiment, the pockets are mounted rotatably onto the frame so as to be positioned out of the plane of the frame during insertion of a card. Each pocket being placed uniformly on the holder body has an open-access end such that the encapsulated collectible cards can be inserted into the pocket. In an embodiment, the open-access end is at the top of the pocket. The holder body further includes a binding portion having a plurality of binding holes. The binding holes are formed with and extend from the at least one lateral side edge of the frame.

The present invention is an improved loose-leaf card holder that has strong pockets with for preventing the card from falling out and facilitates users repeated access to the cards. Further, such a loose-leaf card holder is made from a high clarity material and possesses acid free archival quality for storing and displaying encapsulated collectible cards. Moreover, such a loose-leaf card holder has adequate pocket size and strength for storing and displaying encapsulated collectible cards. Other features and advantages of the present invention will become apparent from the following more detailed description, taken in conjunction with the accompanying drawings, which illustrate, by way of example, the principles of the invention.

DETAILED DESCRIPTION

Figure 1:
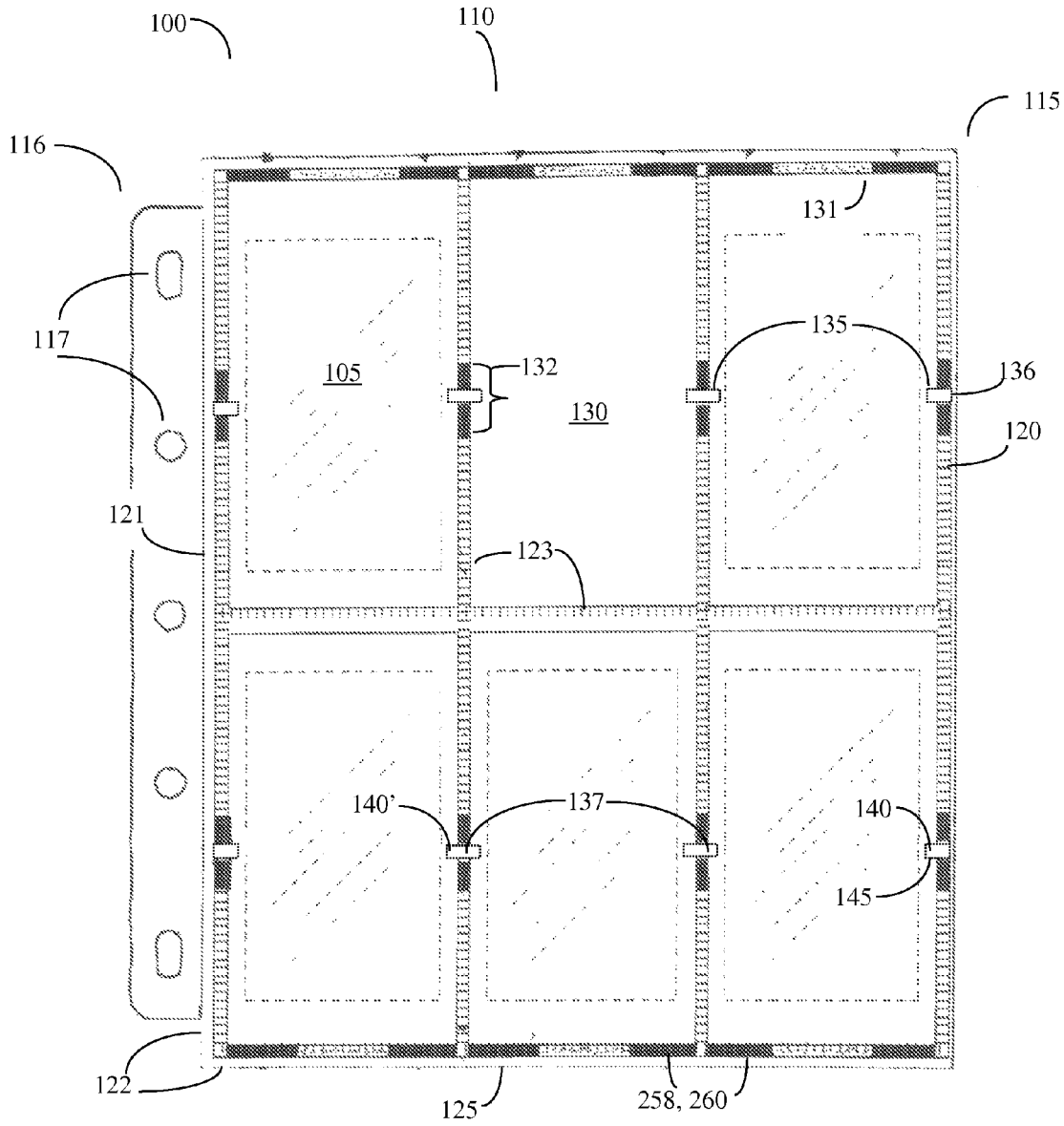
FIG. 1 is a front view of an embodiment of the invention, illustrating a loose leaf card holder for storing and displaying encapsulated collectible cards.

FIG. 1 is a front view of an embodiment of a loose-leaf card holder 100 adapted for storing and displaying a plurality of encapsulated collectible cards 105. Loose-leaf card holder 100 comprises a holder body 110 including frame portion 115 comprised of lateral edge portions 120 and transverse edge portions 125. Cardholder pockets 130 are mounted onto frame portion 115 with mounting pins 135. In an embodiment, pockets 130 have a top loadable open-access end 131 for inserting the encapsulated collectible card 105, configured so that the encapsulated collectible card can be inserted at the open, i.e., unsealed, top edge 131 of the pocket. Note that top edge 131 is straight and forms the top border of pocket 130.

The holder body 110 further includes a binding portion 116 having a plurality of binding holes 117. The binding holes are formed with and extend from the at least one lateral side edge 121 of the frame. The frame is mainly formed from hard molded plastic of sufficient strength and thickness to support pockets mounted thereon, but the frame may also include a thinner border portion 122 around the outer periphery of the frame and attached to the hard molded plastic portion 123 of the frame. This thinner border portion may be formed of a flexible plastic, and it may connect the hard molded plastic portion 123 of the frame to the binding portion 116. Each loose-leaf card holder 100 fits custom made multiple-ring binders and may be bound together in a card storage book.

The holder body 110 may be substantially rectangular in shape. The holder body 110 generally possesses acid free archival quality for a long protection of the professionally graded sports cards 105. The pockets 130 are generally transparent in nature. The pockets 130 are generally made from a hard plastic, which may be molded. This material is exemplary and not limiting. The material generally possesses high clarity for the long term display of professionally graded sports cards 105.

In an embodiment, cardholder pockets 130 are rotatably mounted onto frame portion 123 with mounting pins 135. In an embodiment, mounting pins may be formed as integral extensions of mounting regions 132 that are molded as an integral part of frame portion 123. In an alternate embodiment, mounting regions 132 may be molded integrally with frame portion 123, but each mounting region may have an opening therethrough through which a separate cylindrical mounting pin 135 may be inserted. In another alternate embodiment, mounting regions 132 may be formed separately from frame portion 123 and attached fixedly thereto. The details of the mounting pin and mounting region construction are exemplary and not limiting. Any construction which allows the pockets to be secured to, and rotatably mounted on, rounded supports can be used. In the embodiment shown, edge mounting pins 136 have only a single engagement protrusion 140 that, in an embodiment, mates with an engagement receptacle 145 on or near a lateral edge 120 of a single cardholder pocket 130. Central mounting pins 137 have two engagement protrusions 140' that, in an embodiment, mate with engagement receptacles 145 on or near lateral edges 120 of two cardholder pockets 130. The mounting pins 135 may be constructed of a single, dowel-like piece, or alternately they may be sprung so as to be compressible, to secure the pockets 130 onto the pins 135 with a pressure fitting. In an alternate embodiment, the pocket or pockets 130 may clip onto the mounting pins 135. The clip mechanism may be a snap-lock configuration to secure the pockets 130 to the pins 135.

In the embodiment shown, mounting pins 135 are positioned close to the centers of lateral edge portions 120, such that cardholder pockets 130 rotate substantially about their lateral centers. Whereas this is the preferred embodiment since it provides balance and relative ease in rotating cardholder pockets 130, this positioning of mounting pins 135 is exemplary and not limiting. The mounting pins could be positioned at nearly any point of lateral edge portions 120, subject to avoiding interference with brakes 150 during rotation. Brakes 150 prevent CCW rotation of pockets 130. In the embodiment shown in FIGS. 2*a* and 2*b*, top transverse edge 246 of pockets 130 and bottom transverse edge 246' of pockets 130 are angled, and fit with and will be stopped by edges 255 and 255' of brakes 150. This angled shaping and fitting of the edges of the pockets with the brakes is exemplary and not limiting. Other shapes and configurations of the pockets and brakes may be used, as long as the brakes prevent CCW rotation of pockets 130. In an embodiment, brakes 150 include magnets 258, and will hold pockets 130 in closed position by contacting magnetic closure pieces 260 on pockets 130. Magnetic closure pieces 260 may be magnets or may be metal pieces attracted to the magnetic brakes. Note that brakes 150 and magnetic closure pieces 260 may extend across all of, or any portion of, the transverse edges of the pockets.

Figure 2A:
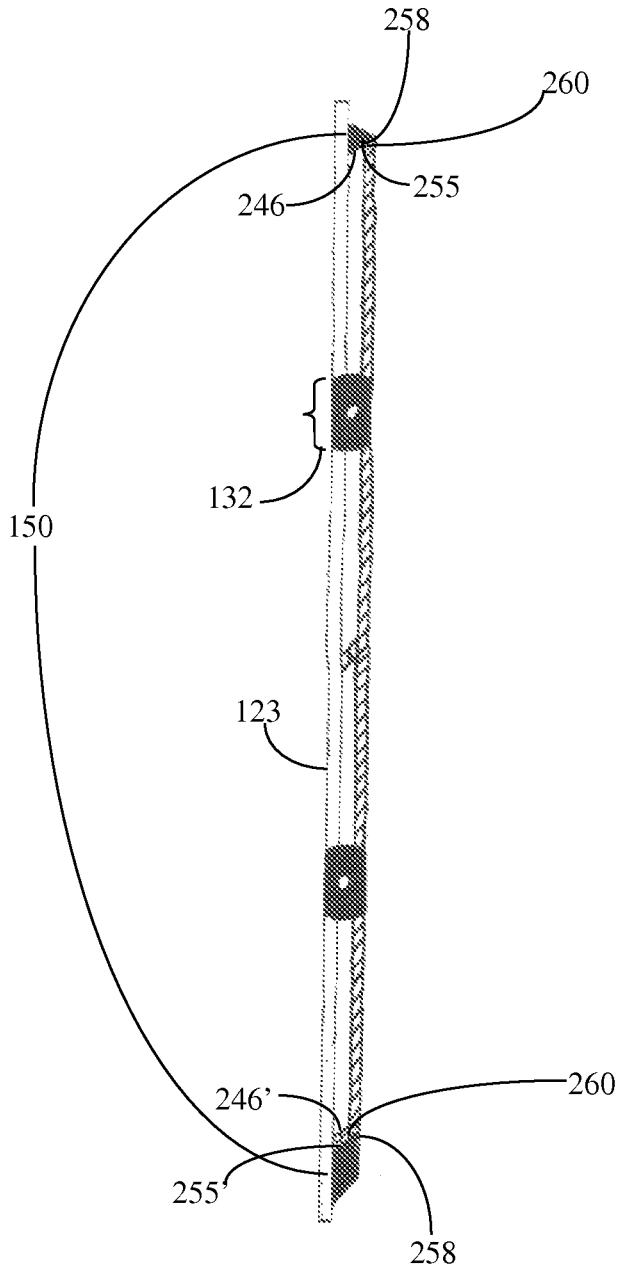
FIG. 2*a* is a side cross sectional view of an embodiment of the invention, illustrating the pockets in closed position.
Figure 2B:
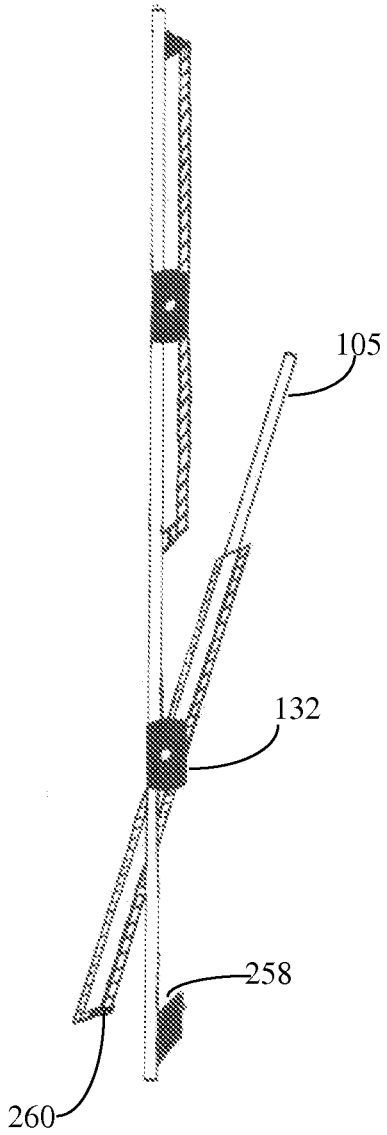
FIG. 2*b* is a side cross sectional view of the embodiment of FIG. 2*a*, illustrating the insertion of a professionally graded sports card into a pocket rotated into open position.

FIG. 2*a* is a side cross sectional view of an embodiment of the invention, illustrating the pockets in closed position. FIG. 2*b* is a side cross sectional view of the embodiment of FIG. 2*a*, illustrating the insertion of an encapsulated collectible card into a pocket rotated into open position. Note that pocket 130 is constructed with a cavity 205 sized to fit encapsulated collectible card 105, and in particular having thickness 210 sufficient to accommodate card 105.

In an embodiment the pockets are constructed in hard molded plastic or alternately in multiple pieces of hard plastic assembled to form a three dimensional pocket as shown.

While a particular form of the invention has been illustrated and described, it will be apparent that various modifications can be made without departing from the spirit and scope of the invention. For example, the number of pockets may be changed, the pockets may be manufactured in various size and dimensions so as to accommodate cards with different sizes. The card holder may be made of materials other than those specifically disclosed, having similar characteristics to the disclosed materials. Accordingly, it is not intended that the invention be limited, except as by the appended claims.

What is claimed is:

1. A loose-leaf card holder adapted for storing and displaying encapsulated collectible cards, comprising:

a frame comprised of a plurality of pocket frame lateral edge portions and pocket frame transverse edge portions, said pocket frame lateral edge portions and pocket frame transverse edge portions forming a rectilinear planar frame grid in a plane of said frame, said frame having lateral frame edge portions and transverse frame edge portions, said pocket frame lateral edge portions and said pocket frame transverse edge portions forming a plurality of rectangular pocket spaces;

a plurality of pockets mounted in said rectangular pocket spaces formed by said pocket frame lateral edge portions and pocket frame transverse edge portions; each said pocket configured to be in an open position or a closed position; each said pocket when in said closed position being coplanar with said plane of said frame;

each said pocket configured to hold one said encapsulated collectible card, wherein;

said pockets are mounted rotatably onto the frame with a plurality of mounting pins attached to said frame; said pockets and said mounting pins configured to rotate said pockets in a positive angular direction about an axis of rotation containing said mounting pins, so as to be positioned out of plane of the frame in an open position during insertion of a card;

said frame and said pockets together forming a frame sheet;

wherein said axis of rotation is parallel to said transverse frame edge portions; and further including a binding portion attached to a lateral edge of the frame sheet for mounting said frame sheet in a binder.

2. The loose-leaf card holder of claim 1, wherein said axis of rotation is positioned near the center of said pocket frame lateral edge portions.

3. The loose-leaf card holder of claim 1, wherein each said pocket has an opening at a top transverse edge for insertion of said card, said opening having a thickness at least as large as a thickness of said encapsulated collectible card.

4. The loose-leaf card holder of claim 1, wherein said pockets are made from an acid-free archival-quality material.

5. The loose-leaf card holder of claim 1, further including at least one brake for each said pocket to prevent said pocket from rotating in a negative angular direction.

6. The loose-leaf card holder of claim 5, wherein said at least one brake is mounted on a pocket frame transverse edge portion.

7. The loose-leaf card holder of claim 6, including a magnetic closure on each said pocket.

8. The loose-leaf card holder of claim 1, wherein said mounting pins have engagement protrusions that mate with engagement receptacles on or near lateral edges of said pocket.

9. The loose-leaf card holder of claim 8, wherein said mounting pins are sprung so as to be compressible, to secure the pocket onto the pins with a pressure fitting.

10. The loose-leaf card holder of claim 8, wherein the pocket clips onto said mounting pins.

* * * * *